US010000883B1

(12) United States Patent
Nolan

(10) Patent No.: US 10,000,883 B1
(45) Date of Patent: Jun. 19, 2018

(54) OVERFLOW PAN FOR AN APPLIANCE

(71) Applicant: Franklin James Nolan, Winter Garden, FL (US)

(72) Inventor: Franklin James Nolan, Winter Garden, FL (US)

( * ) Notice: Subject to any disclaimer, the term of this patent is extended or adjusted under 35 U.S.C. 154(b) by 0 days. days.

(21) Appl. No.: 15/641,398

(22) Filed: Jul. 5, 2017

(51) Int. Cl.
*B65D 1/34* (2006.01)
*D06F 39/08* (2006.01)

(52) U.S. Cl.
CPC ..... *D06F 39/082* (2013.01); *B65D 1/34* (2013.01)

(58) Field of Classification Search
CPC ..... B08B 17/025; D06F 39/082; Y10T 137/5762; G01M 3/04; Y10S 428/913
USPC ..... 137/312, 362; 4/640; 222/108; 220/571
See application file for complete search history.

(56) References Cited

U.S. PATENT DOCUMENTS 4,028,118 A * 6/1977 Nakasuji ..... C08K 5/0041 106/31.19
5,339,676 A 8/1994 Johnson
D388,566 S 12/1997 Reid
5,883,300 A 3/1999 Johnson
6,175,310 B1 1/2001 Gott
6,637,453 B2 * 10/2003 Robinson ..... A61G 13/102 128/849
7,124,772 B1 10/2006 Browning
8,416,089 B1 4/2013 Clary
2010/0294721 A1 * 11/2010 Frazier ..... G01M 3/04 210/660
2014/0326685 A1 * 11/2014 Frazier ..... A47B 97/00 211/13.1

FOREIGN PATENT DOCUMENTS

WO 2010132118 A2 11/2010

* cited by examiner

*Primary Examiner* — Reinaldo Sanchez-Medina

(57) ABSTRACT

The improved overflow pan for an appliance comprises a pan place under an appliance to collect water that may leak from the appliance, from water supply lines connected to the appliance, from condensation created by operation of the appliance, or from failure of the drainage system. The improved overflow pan for an appliance comprises a drain to allow the collected water to flow away from the area of the appliance. The improved overflow pan for an appliance undergoes a thermochromatic color change of the pan that is triggered by water collecting in the pan. The thermochromatic color change provides a distinct visual cue that water may not be draining from the pan properly.

8 Claims, 3 Drawing Sheets

OVERFLOW PAN FOR AN APPLIANCE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of household appliances, more specifically, an improved overflow pan for an appliance.

SUMMARY OF INVENTION

The improved overflow pan for an appliance comprises a pan place under an appliance to collect water that may leak from the appliance, from water supply lines connected to the appliance, from condensation created by operation of the appliance, or from failure of the drainage system. The improved overflow pan for an appliance comprises a drain to allow the collected water to flow away from the area of the appliance. The improved overflow pan for an appliance undergoes a thermochromatic color change of the pan that is triggered by water collecting in the pan. The thermochromatic color change provides a distinct visual cue that water may not be draining from the pan properly.

An object of the invention is to collect water leaking from an appliance in a pan placed under the appliance.

Another object of the invention is to allow the collected water to flow away from the appliance in a controlled manner via a drain and drain line.

Yet another object of the invention is to provide a thermochromatic color change of the pan triggered by water collecting in the pan.

A further object of the invention is to provide a visual indication of the height of the collected water in the pan.

These together with additional objects, features and advantages of the improved overflow pan for an appliance will be readily apparent to those of ordinary skill in the art upon reading the following detailed description of the presently preferred, but nonetheless illustrative, embodiments when taken in conjunction with the accompanying drawings.

In this respect, before explaining the current embodiments of the improved overflow pan for an appliance in detail, it is to be understood that the improved overflow pan for an appliance is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the improved overflow pan for an appliance.

It is therefore important that the claims be regarded as including such equivalent construction insofar as they do not depart from the spirit and scope of the improved overflow pan for an appliance. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
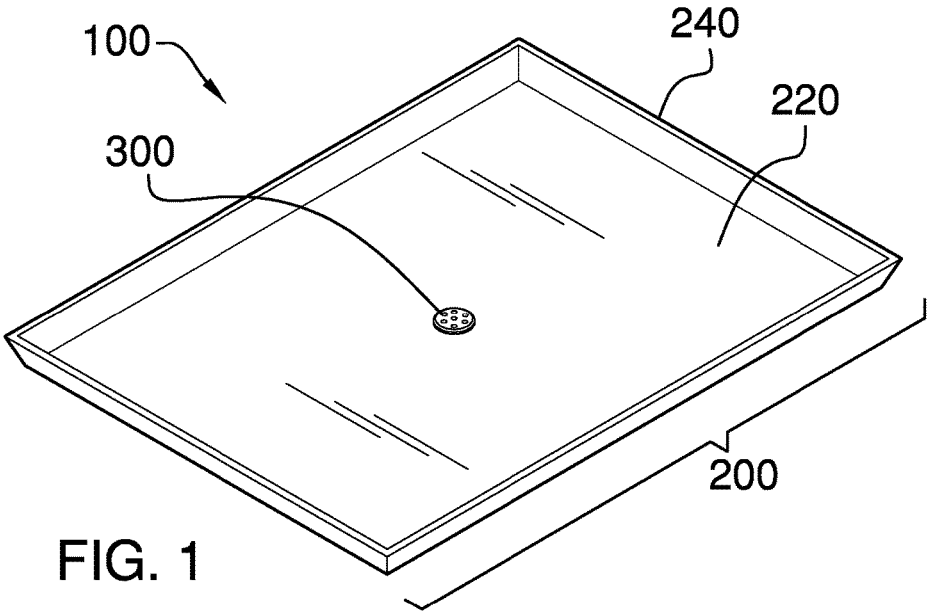
FIG. 1 is a perspective view of an embodiment of the disclosure.
Figure 2:
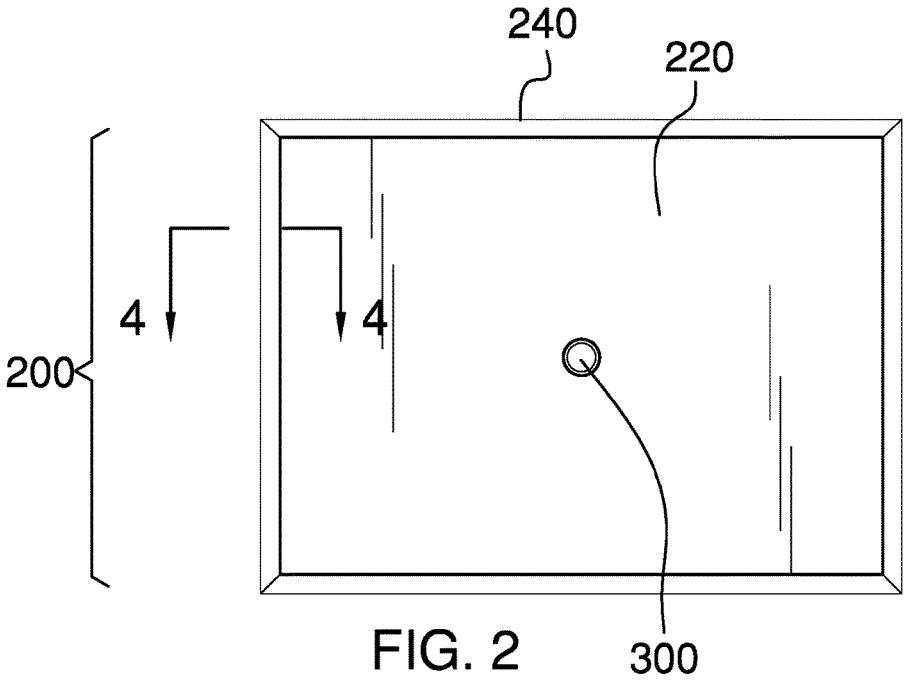
FIG. 2 is a bottom view of an embodiment of the disclosure.
Figure 3:
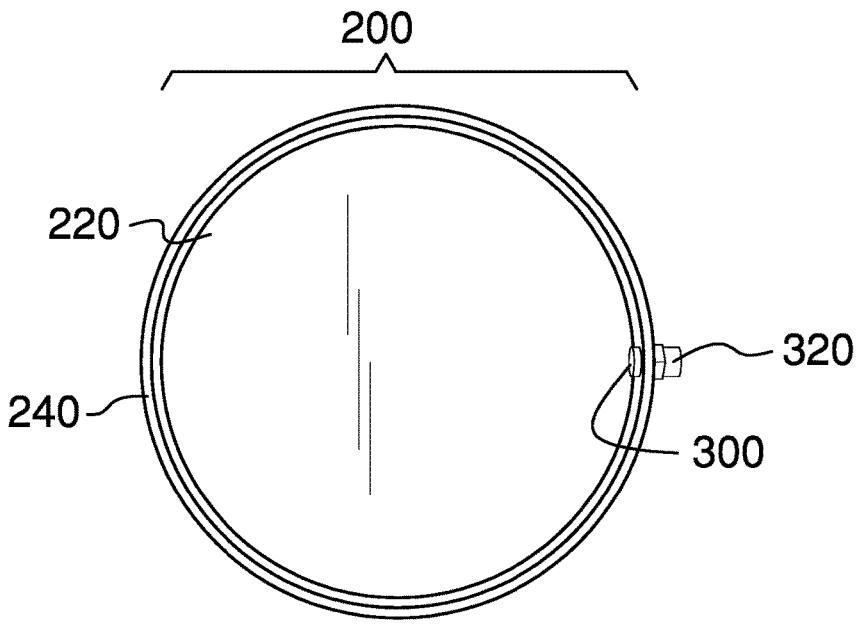
FIG. 3 is a top view of an alternative embodiment of the disclosure.
Figure 4:
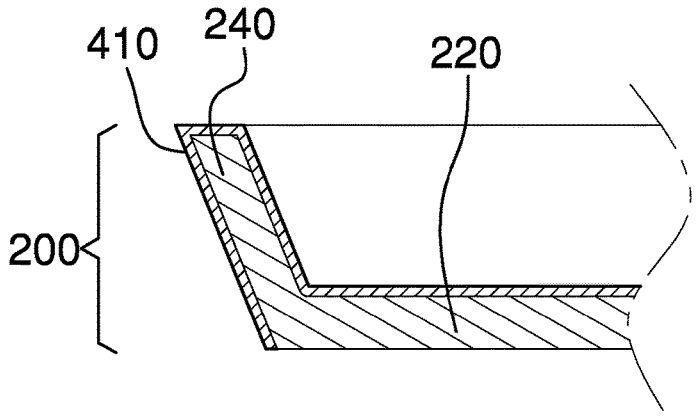
FIG. 4 is a cross-sectional view of an embodiment of the disclosure across 4-4 as shown in FIG. 2.
Figure 5:
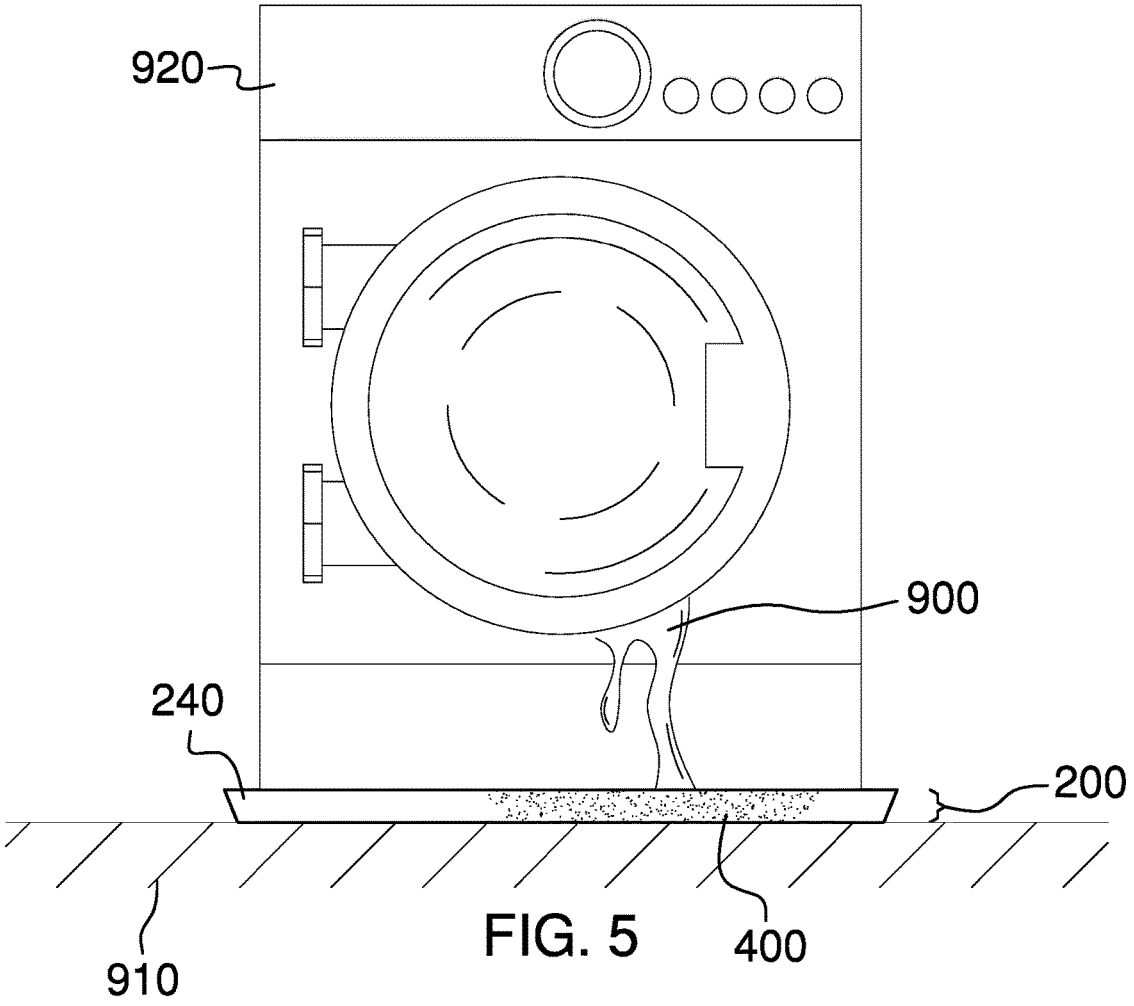
FIG. 5 is a front view of an embodiment of the disclosure as used with a washing machine.

Detailed reference will now be made to a first potential embodiment of the disclosure, which is illustrated in FIGS. 1 through 5.

The improved overflow pan for an appliance 100 (hereinafter invention) comprises a pan 200 and a drain 300. The invention 100 undergoes a thermochromatic color change 400 such that when the pan 200 is exposed to water 900, the pan 200 changes color responsive to the temperature of the water 900.

The pan 200 comprises a bottom panel 220 and a side wall 240. The bottom panel 220 comprises a flat surface oriented to be parallel to a floor 910 that it sets on. The side wall 240 couples to the bottom panel 220 around the entire perimeter of the bottom panel 220 and extends upwards from the bottom panel 220. The height of the side wall 240 is selected to assure that the side wall 240 is tall enough for the pan 200 to hold a few gallons of the water 900 and low enough to not interfere with installation or operation of an appliance 920. Generally, the height of the side wall 240 will be between ¾ inch and 3 inches tall. The bottom panel 220 and the side wall 240 are made from waterproof materials and the pan 200 formed by the combination of the bottom panel 220 and the side wall 240 is able to hold the water 900 without leaking. For that reason, the bottom panel 220 and the side wall 240 are generally molded from plastic as a single unit.

The pan 200 is installed at the location of the appliance 920. The appliance 920 sits inside the pan 200 with the bottom of the appliance 920 resting on the bottom panel 220. The pan 200 is intended to catch the water 900 that may be leaking from the appliance 920 or leaking from water supply lines (not illustrated in the figures) feeding into the appliance 920. If the water 900 leaks from the appliance 920, the water 900 is collected in the pan 200 and does not flow to other parts of the building or soak into the floor 910.

The shape of the pan 200 varies according to the appliance 920 that it is intended to be used with. As non-limiting examples, the pan 200 may be rectangular to accommodate a washing machine or A/C air handler and the pan 200 may be round to accommodate a water heater.

The drain 300 comprises an exit point for the water 900 that has leaked into the pan 200. The drain 300 may comprise a hole in the bottom panel 220 or in the lower half of the side wall 240. A drain line (not illustrated in the figures) may couple to the drain 300 via a drain line coupling 320. In some embodiments, the invention 100 may comprise the drain line coupling 320.

Under normal circumstances, the water 900 that enters the pan 200 will flow out of the drain line via the drain 300. However, it is possible that the drain 300 or the drain line may become obstructed due to foreign material. As a non-limiting example, foreign material may take the form of lint, paper, or dirt that fall or drift into the pan 200, objects such as socks and washcloths that are dropped near the appliance 920, or a buildup of mildew in damp environments. If such an obstruction exists and a leak develops at the appliance 920, the pan 200 is at risk of overflowing if the leak continues to fill the pan 200 while the pan 200 is unable to discharge the water 900 through the drain 300 and the drain line.

The pan 200 may undergo the thermochromatic color change 400 that serves to call attention to the presence of the water 900. The thermochromatic color change 400 is due to an ink, dye, paint, additive, or other thermochromatic coloring agent used during the fabrication of the pan 200.

In some embodiments, the coloring agent may be mixed into the polymer used to mold the pan 200 and will therefore be an intrinsic property of the pan 200.

In some embodiments, the coloring agent may applied as a color-changing layer 410 after the pan 200 is molded.

If the water 900 leaks into the pan 200, the water 900 may be a temperature that triggers the thermochromatic color change 400. As a non-limiting example, the water 900 may be chilled either because it is coming from the cold water supply line, because it is condensation from an evaporator coil, or because the water 900 collected in the pan 200 is slowly evaporating, which is a cooling process. As a non-limiting example, the water 900 may be warmed because it is coming from the hot water supply line or because it is heated water leaking from a hot water heater.

The thermochromatic color change 400 may occur on the outside of the side wall 240 of the pan 200 even if that area of the pan 200 is not directly exposed to the water 900 because the water 900 held inside of the pan 200 may heat/cool the inside of the side wall 240 and the temperature change on the inside of the pan 200 may propagate through the side wall 240 to the outside of the pan 200.

The extent of the thermochromatic color change 400 may give an indication of the level of water held in the pan 200. If the thermochromatic color change 400 is limited to the lowest 10% of the side wall 240 it may be interpreted as an early stage leak. As the height of the thermochromatic color change 400 rises it may be interpreted that they leak is becoming increasing more urgent. As the height of the thermochromatic color change 400 approaches the top of the side wall 240 it may be interpreted that immediate attention to resolve the source of the leak and/or the source of the drain blockage is required.

With respect to the above description, it is to be realized that the optimum dimensional relationship for the various components of the invention described above and in FIGS. 1 through 5, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. An improved overflow pan for an appliance comprising:

a pan and a drain;

wherein when the pan is exposed to water, the pan undergoes a thermochromatic color change—changing color responsive to the temperature of the water;

wherein the pan comprises a bottom panel and a side wall;

wherein the bottom panel comprises a flat surface oriented to be parallel to a floor that it sets on;

wherein the side wall couples to the bottom panel around the entire perimeter of the bottom panel and extends upwards from the bottom panel;

wherein the height of the side wall is between ¾ inch and 3 inches tall;

wherein the bottom panel and the side wall are made from waterproof materials;

wherein the pan is able to hold the water without leaking;

wherein the pan is installed at the location of said appliance;

wherein the appliance sits inside the pan with the bottom of the appliance resting on the bottom panel;

wherein the pan catches water that leaks from the appliance or from water supply lines feeding into the appliance;

wherein the drain comprises an exit point for the water that has leaked into the pan;

wherein the drain comprises a hole in the bottom panel or in the lower half of the side wall;

wherein a drain line couples to the drain via a drain line coupling;

wherein the pan undergoes the thermochromatic color change that serves to call attention to the presence of the water;

wherein the thermochromatic color change is due to a thermochromatic coloring agent during the fabrication of the pan.

2. The improved overflow pan for an appliance according to claim 1 wherein the bottom panel and the side wall are molded from plastic as a single unit.

3. The improved overflow pan for an appliance according to claim 1 wherein the improved overflow pan comprises the drain line coupling.

4. The improved overflow pan for an appliance according to claim 3 wherein the coloring agent is mixed into the polymer used to mold the pan and is therefore an intrinsic property of the pan.

5. The improved overflow pan for an appliance according to claim 3 wherein the coloring agent is applied as a color-changing layer after the pan is molded.

6. The improved overflow pan for an appliance according to claim 3 wherein the water leaking into the pan triggers the thermochromatic color change.

7. The improved overflow pan for an appliance according to claim 6 wherein the temperature of the water held inside of the pan heats or cools the inside of the side wall;

wherein the temperature of the water held inside of the pan propagates through the side wall to the outside of the pan;

wherein the thermochromatic color change occurs on the outside of the side wall of the pan.

8. The improved overflow pan for an appliance according to claim 7 wherein the extent of the thermochromatic color change gives an indication of the level of the water held in the pan.

* * * * *